US010005045B2

(12) United States Patent
Shimoda et al.

(10) Patent No.: US 10,005,045 B2
(45) Date of Patent: Jun. 26, 2018

(54) METHOD AND DEVICE FOR PRODUCING COMPOSITION HAVING DISPERSE PHASE DISPERSED IN CONTINUOUS PHASE

(71) Applicant: KYUSHU UNIVERSITY, NATIONAL UNIVERSITY CORPORATION, Fukuoka-shi, Fukuoka (JP)

(72) Inventors: Mitsuya Shimoda, Fukuoka (JP); Naohiro Karatani, Fukuoka (JP); Hiroki Yachigo, Fukuoka (JP); Miki Masuo, Fukuoka (JP)

(73) Assignee: KYUSHU UNIVERSITY, NATIONAL UNIVERSITY CORPORATION, Fukuoka-Shi, Fukuoka (JP)

( * ) Notice: Subject to any disclaimer, the term of this patent is extended or adjusted under 35 U.S.C. 154(b) by 318 days.

(21) Appl. No.: 14/759,110

(22) PCT Filed: Jan. 10, 2014

(86) PCT No.: PCT/JP2014/050327
§ 371 (c)(1),
(2) Date: Jul. 2, 2015

(87) PCT Pub. No.: WO2014/109385
PCT Pub. Date: Jul. 17, 2014

(65) Prior Publication Data

US 2015/0343401 A1 Dec. 3, 2015

(30) Foreign Application Priority Data

Jan. 10, 2013 (JP) ..... 2013-002664

(51) Int. Cl.
*B01F 3/08* (2006.01)
*B01F 5/06* (2006.01)

(52) U.S. Cl.
CPC ..... *B01F 3/0811* (2013.01); *B01F 3/0807* (2013.01); *B01F 5/0692* (2013.01);
(Continued)

(58) Field of Classification Search
CPC .... B01F 3/0811; B01F 3/0807; B01F 5/0692; B01F 2003/0849; B01F 2215/04
(Continued)

(56) References Cited

U.S. PATENT DOCUMENTS 8,981,022 B2 * 3/2015 Shimoda ..... B01F 3/0807 526/219.5
2003/0215394 A1 * 11/2003 Short ..... A61K 9/0009 424/9.52
(Continued)

FOREIGN PATENT DOCUMENTS

EP 0 884 100 A1 12/1998
JP 2006-346565 A 12/2006
(Continued)

OTHER PUBLICATIONS

Vladisavljević et al., Effect of Emulsifier Type on Droplet Disruption in Repeated Shirasu Porous Glass Membrane Homogenization, Langmuir 2006, 22, 4526-4533.*
(Continued)

*Primary Examiner* — Daniel S Metzmaier
(74) *Attorney, Agent, or Firm* — Birch, Stewart, Kolasch & Birch, LLP

(57) ABSTRACT

A method for producing a composition having a disperse phase with small particle size dispersed in a continuous phase and having greater than 20% by volume of a disperse phase. The method comprising a permeation step, wherein a mixture of a continuous phase liquid and a disperse phase liquid simultaneously permeate a circumferential surface of a cylinder, which is partially or wholly composed of a
(Continued)

(A)

(B)

porous membrane. The cylinder having outlets for the composition in the cross sections of both ends of the cylinder. The porous membrane having an average pore size of not smaller than 5 μm at a membrane permeation rate of not lower than 50 $m^3/m^2h$. The porous membrane cylinder having a longitudinal effective membrane length, L, the internal diameter of the outlets, d, and the membrane permeation rate, F, which satisfy the relationships disclosed herein of L/d and F.

6 Claims, 4 Drawing Sheets

(52) U.S. Cl.
CPC ..... *B01F 2003/0849* (2013.01); *B01F 2215/0431* (2013.01)

(58) Field of Classification Search
USPC ..... 516/18, 29, 73, 924; 514/785; 106/505; 526/219.5; 426/477, 602; 366/165.2
See application file for complete search history.

(56) References Cited

U.S. PATENT DOCUMENTS

2004/0152788 A1* 8/2004 Wu ..... B01F 3/0811 516/9
2008/0044543 A1* 2/2008 McClements ..... A23D 7/0053 426/573
2009/0201761 A1 8/2009 Matsuno et al.
2010/0323573 A1* 12/2010 Chu ..... B01D 65/08 442/153
2013/0137782 A1* 5/2013 Shimoda ..... B01F 3/0807 514/785
2014/0051774 A1* 2/2014 Shimoda ..... B01F 3/0865 514/789
2015/0343401 A1* 12/2015 Shimoda ..... B01F 5/0692 516/9

FOREIGN PATENT DOCUMENTS

JP 2009-297612 A 12/2009
JP 4803508 B2 10/2011
WO WO 2008/038763 A1 4/2008

OTHER PUBLICATIONS

Vladisavljević et al., Production of multiple emulsions for drug delivery systems by repeated SPG membrane homogenization: Influence of mean pore size, interfacial tension and continuous phase viscosity, Journal of Membrane Science 284 (2006) 373-383.*
Extended European Search Report dated Aug. 19, 2016, in European Patent Application No. 14737691.7.
International Search Report, issued in PCT/JP2014/050327, dated Apr. 15, 2014.

* cited by examiner

Influence of membrane permeation rate on droplet size

Average pore size of porous membrane: 20 μm (▲, △); 10 μm (■); 5 μm (◆, ◇)
Surfactant: Tween 20 (filled symbol), SDS (open symbol)

Relationship of the viscosities of continuous phase liquid and disperse phase liquid with droplet size (A)
●; 1 mPa·s, ◆; 55 mPa·s, △; 85 mPa·s
Disperse phase viscosity; 17 mPa·s Relationship of the viscosities of continuous phase liquid and disperse phase liquid with droplet size (B)
●; 1 mPa·s, ◆; 55 mPa·s, △; 85 mPa·s
Disperse phase viscosity; 250 mPa·s

METHOD AND DEVICE FOR PRODUCING COMPOSITION HAVING DISPERSE PHASE DISPERSED IN CONTINUOUS PHASE

TECHNICAL FIELD

The present invention relates to a method and device for producing a composition having a disperse phase dispersed in a continuous phase.

BACKGROUND ART

There are known various compositions having a disperse phase dispersed in a continuous phase, including emulsions having a disperse phase liquid dispersed in a continuous phase liquid, and microbubble compositions having a disperse phase gas dispersed in a continuous phase liquid. Conventional emulsions have been prepared by adding a liquid that is to serve as a disperse phase, together with an emulsifying agent such as a surfactant, to a liquid that is to serve as a continuous phase, to give a liquid mixture and mechanically stirring the liquid mixture to micronize the disperse phase.

As exemplary techniques for producing an emulsion more efficiently, there are disclosed in Patent Literatures 1-3 methods for causing an oil-soluble liquid and a water-soluble liquid to permeate a porous membrane. To be specific, Patent Literature 1 discloses that in order to obtain an emulsion having a small average particle size, emulsion production should be done by using a porous membrane having a small pore size and decreasing a membrane permeation rate (par. [0021]). This literature also discloses in Example 1 an example where an emulsion was produced using a porous membrane having an average pore size of 2.7 μm at a membrane permeation rate of 350 cc/3140 $mm^2$ min. This membrane permeation rate can be converted to 6 $m^3/m^2h$.

Patent Literature 2 discloses an example where an emulsion containing 12.5% by mass of a disperse phase was produced using a porous membrane having an average pore size of 5 μm at a membrane permeation rate of 43.3 mL/25 $cm^2$ sec (Example 12). This membrane permeation rate can be converted to 60 $m^3/m^2h$.

Patent Literature 3 discloses an example where an oil-soluble liquid and a water-soluble liquid were allowed to permeate a porous membrane having an average pore size of 5.3 μm and an effective area of 3140 $mm^2$ at a membrane permeation rate of 2 L/min, to thereby produce an emulsion containing 40% by volume of a disperse phase (Example 3). This membrane permeation rate can be converted to 38 $m^3/m^2h$.

Non-patent Literature 1 discloses examples where emulsions each containing a disperse phase at a concentration of 1-20% by volume were produced using porous membranes having an average pore size of 7.6-20.3 μm at a membrane permeation rate of 80-240 $m^3/m^2h$ (Non-patent Literature 1, FIG. 8).

CITATION LIST

Patent Literatures

Patent Literature 1: Japanese Patent Application Publication No. JP H06-39259

Patent Literature 2: Japanese Patent Application Publication No. JP 2003-1080

Patent Literature 3: Japanese Patent Application Publication No. JP 2006-346565

Non-Patent Literature

Non-patent Literature 1: *Journal of Membrane Science,* 284, (2006), p. 373-383

SUMMARY OF INVENTION

Technical Problem

The method of Patent Literature 2 is designed to produce an emulsion using a porous membrane having an average pore size of 5 μm at a membrane permeation rate of 60 $m^3/m^2h$, but the produced emulsion has only a low disperse phase content as low as 12.5% by mass. The method of Non-patent Literature 1 is designed to produce an emulsion using a porous membrane having an average pore size of 7.6-20.3 μm at a membrane permeation rate of 80-240 $m^3/m^2h$, but the produced emulsion has a low disperse phase content as low as 1-20% by volume. On the other hand, the method of Patent Literature 3 is designed to produce an emulsion containing 40% by mass of a disperse phase using a porous membrane having an average pore size of 5.3 μm, but this method uses a low membrane permeation rate as low as 38 $m^3/m^2h$. In other words, in conventional methods, it has been necessary to decrease a disperse phase content in order to achieve a relatively high membrane permeation rate, and on the contrary, to decrease a membrane permeation rate in order to achieve a relatively high disperse phase content. Thus, it has been believed in the conventional art that membrane permeation rate and disperse phase content are in trade-off relationship. This is also evident from the disclosure in Patent Literature 1 which states that in order to obtain an emulsion having a small average particle size, emulsion production should be done by using a porous membrane having a small pore size and decreasing a membrane permeation rate.

In the fields of compositions like emulsions which have a disperse phase being dispersed in a continuous phase, there has been a demand to produce a composition having a small dispersed particle size with high productivity, but it has been difficult to meet this demand in conventional methods.

In light of the aforementioned circumstances, an object of the present invention is to provide a method for producing, with high productivity, a composition having a disperse phase dispersed with a small particle size in a continuous phase.

Solution to Problem

The present inventors found that the aforementioned object can be achieved by using a porous membrane having an average pore size of not smaller than a specified value and setting a membrane permeation rate to not smaller than a specified value, and thus completed the present invention. More specifically, the aforementioned object is achieved by the present invention which is defined below.

[1] A method for producing a composition having greater than 20% by volume of a disperse phase dispersed in a continuous phase, the method comprising a permeation step at which a continuous phase liquid and a disperse phase liquid are caused to simultaneously permeate a porous membrane having an average pore size of not smaller than 5 μm at a membrane permeation rate of not lower than 50 $m^3/m^2h$.

[2] A composition having a disperse phase finely dispersed in a continuous phase, wherein the disperse phase is present at a concentration of greater than 20% by volume and not greater than 95% by volume of the total volume of the composition, and has a span, as defined by the following equation (1), of 0.4 to 0.6:

$$\text{Span}=(d_{90}-d_{10})/d_{50} \quad (1)$$

where:

$d_{10}$: a particle size when the cumulative distribution of disperse phase particles is 10%, $d_{90}$: a particle size when the cumulative distribution of disperse phase particles is 90%, and $d_{50}$: a particle size when the cumulative distribution of disperse phase particles is 50%.

[3] A device for producing a composition having a disperse phase finely dispersed in a continuous phase, the device comprising:

a cylinder having a circumferential surface partially or wholly composed of a porous membrane, the cylinder being provided with outlets for the composition in the cross sections of both ends thereof, a storage portion for storing a continuous phase liquid and a disperse phase fluid, the storage portion being provided on an outer periphery of the circumferential surface of the cylinder, and a supplying means for simultaneously supplying the continuous phase liquid and the disperse phase fluid from the storage portion into the cylinder.

Advantageous Effects of Invention

The present invention makes it possible to produce, with high productivity, a composition having a disperse phase dispersed with a small particle size in a continuous phase.

DESCRIPTION OF EMBODIMENTS

1. Method for Producing a Composition

Figure 1:
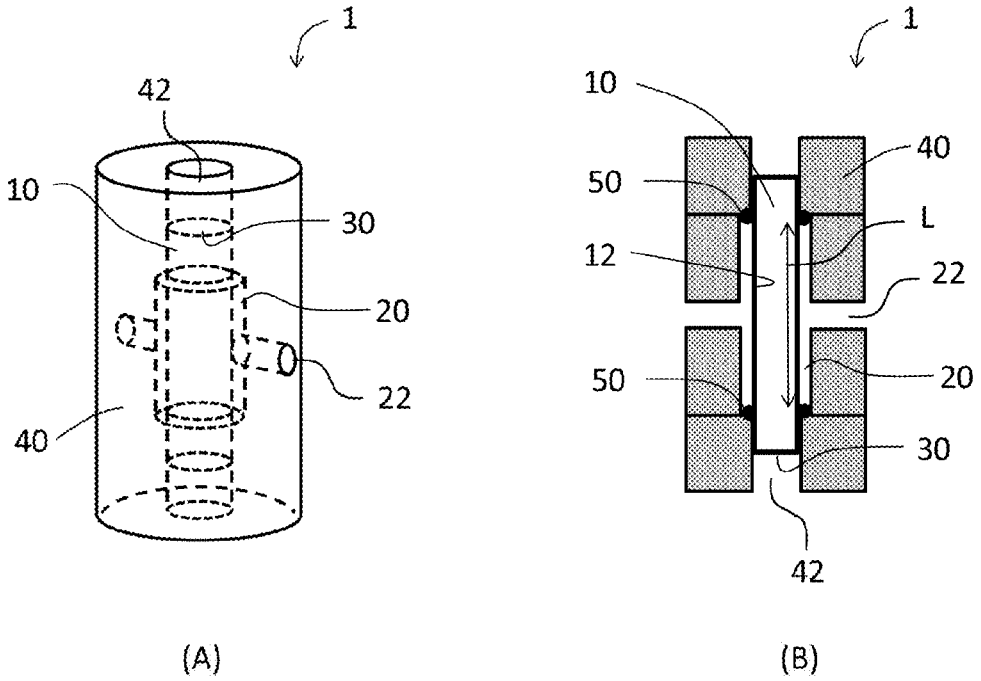
FIG. 1 is a diagram illustrating the outline of the production device of the present invention.

The production method of the present invention comprises a permeation step at which a continuous phase liquid and a disperse phase fluid are caused to simultaneously permeate a porous membrane having an average pore size of not smaller than 5 μm at a membrane permeation rate of not lower than 50 $m^3/m^2h$. Detailed descriptions thereof are given below. As used in this invention, a numerical range expressed as "X to Y" includes the values at both ends, i.e., X and Y.

(1) Permeation

"Permeation" means that a continuous phase liquid and a disperse phase fluid are caused to pass through a membrane from one face to the other face. In the present invention, the continuous phase liquid and the disperse phase fluid are caused to simultaneously permeate a porous membrane at a membrane permeation rate of not lower than 50 $m^3/m^2h$. The term "simultaneously" means that two liquids are supplied to and caused to permeate a membrane at the same timing, and does not include a mode in which it is intentionally designed to cause one liquid to permeate earlier and the other liquid to permeate later.

The simultaneous permeation mode can be broadly classified into the following two modes: a mode in which a continuous phase liquid and a disperse phase fluid are pre-emulsified before being caused to permeate a porous membrane, and a mode in which no pre-emulsification is carried out before permeation. The "pre-emulsified" state refers to a state in which a disperse phase having an average particle size of not greater than 1 mm is dispersed in a continuous phase. In the case of no pre-emulsification, it is preferred that the flow paths of a continuous phase liquid and a disperse phase fluid from their tanks be merged together in the middle to supply them to a porous membrane in the form of a mixture thereof. The present invention can produce an intended effect even without the need for pre-emulsification, and the reason for this may be as follows. In the case of no pre-emulsification before supply of a continuous phase liquid and a disperse phase fluid to a membrane, disperse phase particles with a diameter of greater than 1 mm are supplied onto a surface of the porous membrane. In this invention, the two fluids are supplied to the membrane at a specified rate; then, it follows that said disperse phase particles receive a force greater than the Laplace pressure which depends on the pore size, due to a sufficiently high flow rate of the continuous phase liquid. As a result, the disperse phase fluid makes an entry into pores, thereby being micronized according to the mechanism described later.

In the present invention, it is necessary that the membrane permeation rate be not lower than 50 $m^3/m^2h$. The membrane permeation rate is defined as the volume of a mixed fluid permeating a membrane per unit area per unit time. As regards its lower limit, the membrane permeation rate is preferably not lower than 60 $m^3/m^2h$, greater than 200 $m^3/m^2h$, greater than 400 $m^3/m^2h$, greater than 800 $m^3/m^2h$, or greater than 1600 $m^3/m^2h$. As regards its upper limit, the membrane permeation rate is preferably not greater than 2000 $m^3/m^2h$, not greater than 1600 $m^3/m^2h$, not greater than 800 $m^3/m^2h$, or not greater than 400 $m^3/m^2h$.

The permeation step can be carried out one or more times, but in the present invention which is characterized by a high membrane permeation rate, a monodispersed composition can be obtained even after only one time of the permeation step.

(2) Porous Membrane

The porous membrane refers to a membrane having a large number of fine through-holes. As such a membrane, a known porous membrane made of glass, ceramic, nickel, or the like can be used. In the present invention, a porous membrane made of glass is preferred, and a porous membrane made of Shirasu porous glass (hereinafter also referred to as "SPG membrane") is more preferred. The porous membrane used in this invention has an average pore size of not lower than 5 μm. Adopting a porous membrane having an average pore size of not lower than 5 μm allows a continuous phase liquid and a disperse phase fluid to permeate the porous membrane at a high rate without causing the breakage of the membrane. In this invention, these fluids are caused to permeate at a high rate; thus, even if a porous membrane with an average pore size of not lower than 5 μm is adopted, what can be produced is a composition containing a disperse phase with a smaller average particle size than said pore size. The average pore size of the porous membrane can be measured by mercury intrusion porosimetry (using an automated porosimeter).

The shape of the porous membrane is not particularly limited, and can be a disk, a flat plate, or a cylinder. However, a cylinder capable of withstanding a high membrane permeation rate is preferred. The cylinder refers to a cylindrical member whose inside is hollow. In the present invention, it is preferred that the cylinder have a circumferential surface partially or wholly composed of a porous membrane. By "have(ing) a circumferential surface partially or wholly composed of a porous membrane", it is meant that part of the circumferential surface is composed of a porous membrane, and the remaining part thereof may be composed of other materials. Using also other materials than a porous membrane to form a cylinder makes it possible to adjust a membrane area that is effectively usable for production of the composition (hereinafter also referred to as "effective membrane area").

The present invention can provide high productivity since a continuous phase liquid and a disperse phase fluid (hereinafter also collectively referred to as "source liquids") are caused to permeate a porous membrane at a high rate. However, if the composition accumulates within the device, the pressure in the device may increase, leading to the breakage of the device, or an excessive pressure may be applied to the composition, causing disperse phase particles to be merged together again; thus, it may become difficult to control the particle size. Hence, in the process of production, it is preferred to avoid the accumulation of the composition within the device.

In order to suppress the accumulation of the composition, it is important to increase the discharge capacity to match the membrane permeation rate of the source liquids. In the present invention, it is preferred that the source liquids be introduced into a porous membrane from a cylinder's circumferential surface including a porous membrane portion so as to ensure that the pressure from the source liquids can be uniformly applied to the porous membrane, and that the composition be discharged from both ends of the cylinder. In this process, it is more preferred to optimize the effective membrane area and internal diameter of the cylinder to achieve a high discharge capacity. To be specific, if the longitudinal length of a porous membrane portion facing a storage portion and constituting the effective membrane area (hereinafter referred to as "effective membrane length") is defined as L and the internal diameter of a cylinder at its ends, i.e., outlet internal diameter, is defined as d, then L/d and the membrane permeation rate F are preferred to satisfy the following relationships:

1) when 50 $m^3/m^2h \le F \le 200$ $m^3/m^2h$, then $2 \le L/d \le 45$;
2) when 200 $m^3/m^2h < F \le 400$ $m^3/m^2h$, then $2 \le L/d \le 23$;
3) when 400 $m^3/m^2h < F \le 800$ $m^3/m^2h$, then $1 \le L/d \le 12$;
4) when 800 $m^3/m^2h < F \le 1600$ $m^3/m^2h$, then $1 \le L/d \le 6$;
5) when 1600 $m^3/m^2h < F \le 2000$ $m^3/m^2h$, then $1 \le L/d \le 4.4$.

The upper limit for L/d is determined by the average linear velocity at the outlets. According to the investigation made by the present inventors, it is considered that if this average linear velocity is not greater than 5 m/sec, no such failure as described above will occur. The relationship of L/d with the membrane permeation rate F at an average linear velocity of not greater than 5 m/sec is explained below, taking as an example the case where the membrane permeation rate in 1) above is 200 $m^3/m^2h$.

In this case, the volume of the source liquids introduced into the membrane is 200 $(m^3/m^2h) \times d\pi L$ $(mm^2)$. And the total cross-sectional area of the cylinder at its ends is $2 \times (d/2)^2 \pi (mm^2)$. The average linear velocity is calculated by dividing the volume of the source liquids introduced by the cylinder's total cross-sectional area at its ends. Thus, the average linear velocity is as follows:

$$200(m^3/m^2h) \times d\pi L(mm^2)/2 \times (d/2)^2 \pi(mm^2) = 400\ L/d(m/h)$$
$$= (1/9)L/d(m/sec).$$

Since the resultant value is not greater than 5 m/sec, the following relationship is satisfied:

(1/9) L/d (m/sec)≤5 m/sec, then it follows $L/d \le 45$.

On the other hand, the lower limit for L/d is determined by production efficiency. More specifically, in the case where the membrane permeation rate is relatively low (i.e., as low as not greater than 400 $m^3/m^2h$) like in the cases of 1) and 2) above, production efficiency will decrease if L/d is lower than 2, since the effective membrane area will also decrease. Therefore, L/d is preferably not lower than 2. On the contrary, in the case where the membrane permeation rate is relatively high (i.e., as high as greater than 400 $m^3/m^2h$) like in the cases of 3) to 5) above, sufficient production efficiency will be ensured if L/d is not lower than 1.

The dimension of the cylinder has only to satisfy the aforementioned ranges, but from the viewpoint of availability, etc., it is preferred that the cylinder have an internal diameter of 5-100 mm.

As a means for causing the source liquids to permeate, any known means can be used. For example, a pump generating only a few pulsating flows is preferred.

(3) Continuous Phase Liquid

The continuous phase liquid refers to a liquid that is to serve as a continuous phase. In the present invention, a known continuous phase liquid such as an aqueous liquid or an oily liquid can be used. The aqueous liquid refers to a liquid based on water. The oily liquid refers to a liquid based on an organic compound. The composition of this invention cannot be obtained when the continuous phase liquid and the disperse phase fluid are highly compatible with each other; thus, the continuous phase liquid is selected in consideration of its compatibility with the disperse phase fluid to be used.

The continuous phase liquid has only to be a liquid when it is supplied to a porous membrane. Thus, for example, a substance that is solid at room temperature but becomes liquid by heating can also be used as the continuous phase liquid. Alternatively, a supercooled liquid which is liquid at room temperature but solidifies with time can also be used. In consideration of workability, this step is preferably taken at room temperature (20-30° C.), so the continuous phase liquid is preferably liquid at room temperature. Such a liquid is exemplified by an inorganic substance and an organic substance. Examples of the inorganic substance include water, and examples of the organic substance include various edible oils, petroleum fuel oils, chain hydrocarbons having about 20 or less carbon atoms, and aromatic hydrocarbons having about 20 or less carbon atoms.

The continuous phase liquid may contain additives such as a surfactant, an electrolyte, and a viscosity modifier. As the surfactant, a known one can be used, and an anionic or nonionic surfactant is preferred. Since such a surfactant has no positive charge, it has an advantage in that, when a porous membrane made of glass is used, said surfactant and anions arising from silanol groups are not electrostatically attracted to each other, so that the surfactant does not experience a decrease in its activity. Examples of the anionic surfactant include carboxylates, sulfonates, and sulfuric acid ester salts such as sodium lauryl(dodecyl)sulfate. Since the anionic surfactant has ionicity, it has an advantage in that, for example, when polymer fine particles are produced as described below, it can be easily removed by washing. This surfactant is easy to wash out after beads are produced. Examples of the nonionic surfactant include glycerine fatty acid esters, sucrose fatty acid esters, polyoxyethylene alkyl ethers, and polyoxyethylene alkylphenyl ethers. The surfactant can be added in a commonly used amount, but the content of the surfactant in the continuous phase liquid is preferably in the range of 0.01 to 5% by mass, more preferably in the range of 0.02 to 2% by mass. In particular, the content of the anionic surfactant is preferably in the range of 0.1 to 5% by mass, more preferably in the range of 0.2 to 3% by mass.

Examples of the electrolyte include sodium chloride and potassium chloride. Addition of the electrolyte to the continuous phase liquid promotes the formation of an electric double layer on a porous membrane surface, thereby preventing the porous membrane from getting wet with the disperse phase fluid. In turn, the activity of the surfactant can be improved to reduce the size of disperse phase particles produced at the next step. The content of the electrolyte is preferably in the range of 0.5-5.0% by mass in the continuous phase liquid.

As the viscosity modifier, a known one can be used, and preferred examples include hydrophilic polymeric compounds such as carboxymethyl cellulose, polyvinyl alcohols, pectins, and gelatins.

(4) Disperse Phase Fluid

The disperse phase fluid refers to a liquid that is to serve as a disperse phase, and examples include aqueous liquids, oily liquids and gases. The aqueous liquid is as described above in relation to the continuous phase liquid. When an aqueous liquid is used as the disperse phase fluid, a W/O emulsion is obtained as the composition of the present invention. However, in order to finely disperse the disperse phase into the continuous phase in a porous membrane, it is necessary to avoid the porous membrane getting wet with the disperse phase fluid. Therefore, when an aqueous liquid is used as the disperse phase, a hydrophobic porous membrane is preferred, and when an oily liquid or a gas is used as the disperse phase, a hydrophilic porous membrane is preferably used. When the disperse phase fluid is liquid, it may also contain such a surfactant as mentioned above.

The oily liquid refers to, as described above, a liquid based on an organic compound. When an oily liquid is used, an O/W emulsion is obtained as the composition of the present invention. Preferred oily liquids include edible oils and fatty acid esters, but the oily liquid can be selected as appropriate depending on its application. For example, emulsions containing a fatty acid ester such as methyl laurate as a disperse phase are typically useful as cosmetic additives, food additives, or additives for coating materials.

When an oily liquid containing a polymerizable monomer is used, there can be produced an emulsion in which disperse phase particles containing a polymerizable monomer are finely dispersed with low polydispersity. This type of emulsion can be used as a starting material for suspension polymerization. The polymerizable monomer refers to a compound having a polymerizable functional group. Preferred in the present invention is a radical-polymerizable monomer with a radical-polymerizable functional group, which can be easily induced to polymerize by heating in the presence of a radical initiator. In addition, the oily liquid may contain a known coloring agent such as an organic dye, an organic pigment, an inorganic dye, or an inorganic pigment. The coloring agent is preferably a nanometer-sized particulate dispersion. The radical initiator is preferably ADVN or benzoyl peroxide, but can be selected as appropriate depending on its application.

The emulsion of the present invention comprising a polymerizable monomer as a disperse phase provides polymer particles with low polydispersity or, in other words, monodispersed polymer fine particles. Such polymer particles are useful as spacers for liquid crystal display panels, fillers for liquid chromatography separation columns, cosmetic materials, and toner materials. In particular, the composition of this invention comprising a polymerizable monomer as a disperse phase is preferred in the field of toners where polymer particles with extremely low polydispersity are needed for increasing printing resolution. Notably, this invention can produce a composition having dispersed therein a disperse phase with a smaller average particle size than the average pore size of a porous membrane; thus, even in the case of using, for example, a porous membrane having such a relatively large pore size that pores will not be clogged with a pigment, etc., a composition having dispersed therein polymer particles with a small average particle size can be obtained Hence, a composition particularly useful as a toner can be obtained.

When the disperse phase fluid is a gas, a microbubble composition having fine bubbles dispersed in the continuous phase is obtained as the composition of the present invention. In this case, the continuous phase can be an aqueous liquid or an oily liquid. Examples of the gas include air, oxygen, nitrogen, noble gas, carbon dioxide and ozone. When air or nitrogen is used as a gas, a whipped composition useful for producing aerated food products is obtained. When carbon dioxide is used as a gas, a microbubble composition useful for producing carbonated drinks is obtained. Finely dispersing an ozone-containing gas in water serving as a continuous phase is preferable not only for producing ozone water but also as a means for sterilizing water. In addition, cleaning and sterilization using this type of water are also important applications.

(5) Proportions

The proportions of the continuous phase liquid and the disperse phase fluid to be supplied are adjusted such that the disperse phase content is greater than 20% by mass. The disperse phase content is defined as the volume fraction of the disperse phase with respect to the total volume of a composition. As regards its lower limit, the disperse phase content is preferably not lower than 40% by mass, not lower than 50% by mass, or not lower than 60% by mass. As regards its upper limit, the disperse phase content is preferably not greater than 95% by mass or not greater than 80% by mass.

(6) Production of a Composite Composition

When a primary composition obtained by the present invention is used as a disperse phase fluid, a composite composition having the primary composition dispersed in a second continuous phase can be produced. To be specific, a [b]/[a]/[c] composition can be obtained by a method comprising:

the aforementioned permeation step at which a first continuous phase liquid [a] and a first disperse phase fluid [b] are caused to simultaneously permeate a porous membrane having an average pore size of not lower than 5 μm at a membrane permeation rate of not lower than 50 $m^3/m^2h$, whereby a primary composition ([b]/[a]) having dispersed therein greater than 20% by volume of the first disperse phase is prepared; and a step at which the primary composition ([b]/[a]) and a second continuous phase liquid [c] are caused to simultaneously permeate the porous membrane having an average pore size of not lower than 5 μm at a membrane permeation rate of not lower than 50 $m^3/m^2h$, to thereby disperse greater than 20% by volume of the primary composition ([b]/[a]) as a second disperse phase.

(7) Mechanism

The mechanism for producing the effects of the present invention is not limited but may be as follows. For the sake of simplicity, the following description is made on the assumption that the disperse phase fluid is a disperse phase liquid.

The porous membrane used in the present invention is provided with curved pores that are highly uniform in cross-sectional pore area, and these pores are three-dimensionally communicated with each other while they repeatedly diverge and converge. When a continuous phase liquid and a disperse phase liquid are caused to simultaneously permeate such a porous membrane, splitting of the disperse phase liquid takes place. This splitting occurs in a highly uniform fine space; thus, the size of droplets corresponds to the pore size, and an emulsion with low polydispersity can be obtained. This phenomenon is called intra-membrane emulsification. It is believed that shearing of the liquid into droplets (ligaments) during intra-membrane emulsification mainly takes place at a junction of fine flow paths. More specifically, suppose that the two pores A and B converge at point C. The continuous phase liquid flows wetting a pore wall due to its high affinity with the wall, whereas the disperse phase liquid does not wet the pore wall due to its low affinity with the wall and flows in the state of being enclosed in the continuous phase liquid covering a pore surface. At this time, the thinly-stretched disperse phase liquid (also referred to as "disperse phase ligament") is in contact with the continuous phase liquid via a surfactant.

Then, when the disperse phase ligaments from pores A and B flow into the junction C, the disperse phase ligaments A and B do not eliminate the surfactant molecules covering the pore surface to merge into one continuous ligament, but instead shearings of ligament A by ligament B, and of ligament B by ligament A, take place alternately while the surfactant molecules are retained on the pore surface. As a result, downstream of junction C, there are formed split ligaments D which consist of alternately arranged fragments of ligaments A and B. Thus, there may be obtained the aforementioned composition which has a small particle size, low polydispersity, and high disperse phase content.

2. Composition (1) Disperse Phase Particle Size

The composition of the present invention is produced in the form of an O/W emulsion when using an aqueous liquid as a continuous phase liquid and an oily liquid as a disperse phase fluid, or in the form of a W/O emulsion when using an oily liquid as a continuous phase liquid and an aqueous liquid as a disperse phase fluid, or in the form of a microbubble composition when using an oily liquid or an aqueous liquid as a continuous phase liquid and a gas as a disperse phase fluid.

The particle size of disperse phase particles is determined by the laser diffraction/scattering method, and the average particle size which is defined as a median particle size ($d_{50}$), a value when the cumulative volume percentage of particles is 50%, is preferably in the range of 1 to 50 μm, more preferably in the range of 1 to 30 μm.

The span (polydispersity) defined by the equation (1) mentioned below is preferably not greater than 0.6, more preferably not greater than 0.5. The lower the span is, the more preferred it is. As for its lower limit, the span is preferably not lower than 0.4, more preferably not lower than 0.3. For the purpose of the present invention, having a span of 0.3 to 0.6 is referred to as being monodispersed.

$$\text{Span}=(d_{90}-d_{10})/d_{50} \quad (1)$$

where:

$d_{10}$: a particle size when the cumulative distribution of disperse phase particles is 10%, $d_{90}$: a particle size when the cumulative distribution of disperse phase particles is 90%, and $d_{50}$: a particle size when the cumulative distribution of disperse phase particles is 50%.

(2) Disperse Phase Content

The composition of the present invention has a disperse phase content of greater than 20% by volume. The disperse phase content is defined as the percentage by volume of a disperse phase with respect to a composition, and can be calculated by, for example, the specific gravities of a continuous phase liquid, a disperse phase fluid, and a prepared composition. A composition having a disperse phase content of greater than 20% by volume may well be said to contain a disperse phase at high concentrations, and thus is preferred as a masterbatch composition. The preferred upper and lower limits for disperse phase content are as described above.

(3) Applications

As described above, the O/W and W/O emulsion compositions of the present invention are useful as food additives, additives for coating materials, spacers for liquid crystal display panels, fillers for liquid chromatography separation columns, cosmetic materials, toner materials, and the like. Also, as described above, the microbubble composition of this invention is useful for producing whipped compositions, carbonated drinks, or ozone water.

(4) Composite Composition

As described above, when the production method of the present invention is carried out two or more times, a composite composition having a [b]/[a] composition dispersed in [c] can be obtained. In this process, it is preferable that the average particle size and span of the [b]/[a] composition serving as a final disperse phase fall within the ranges mentioned above.

3. Device

The preferred device for carrying out the production method of the present invention is a production device comprising:

a cylinder having a circumferential surface partially or wholly composed of a porous membrane, the cylinder being provided, in the cross sections of both ends thereof, with outlets for a composition having a disperse phase finely dispersed in a continuous phase, a storage portion for storing a continuous phase liquid and a disperse phase fluid, the storage portion being provided on an outer periphery of the circumferential surface of the cylinder, and a supplying means for simultaneously supplying the continuous phase liquid and the disperse phase fluid from the storage portion into the cylinder.

FIG. 1 shows a preferred mode of the inventive production device. FIG. 1A is a perspective view of the inventive device, and FIG. 1B is a cross-sectional view of the inventive device. In FIG. 1, 1 represents a production device, 10 represents a cylinder, 12 represents a porous membrane portion, 20 represents a storage portion, 22 represents an inlet, 30 represents an outlet, 40 represents an outer peripheral member, 42 represents a discharge inlet, and 50 represents a seal. A supplying means 60 is not shown in FIG. 1A. The porous membrane portion 12 and the seal 50 are also omitted in FIG. 1A.

(1) Cylinder 10

The cylinder 10 and a porous membrane constituting the same are as described above. The porous membrane portion 12 refers to a portion permeated by a continuous phase liquid and a disperse phase fluid (source liquids). The other part of the cylinder besides this portion may be composed of other members, or alternatively, the porous membrane may be provided with a coating on its inner or outer wall surface to prevent the source liquids from leaking out of the cylinder. That part of the cylinder which is in contact with the outer peripheral member 40 is preferably provided with seals 50 to prevent liquid leakage. As the seal 50, a known sealing material such as O-ring can be used. The outer peripheral member 40 refers to a member disposed around the cylinder, and is preferably made of a metal such as stainless steel, ceramic, or a plastic.

In FIG. 1, a membrane portion extending between the seals 50 is described as the porous membrane portion 12, and a length between these seals as an effective membrane length L.

(2) Storage Portion 20

The storage portion refers to a space for storing the source liquids. As shown in FIG. 1, the storage portion 20 is preferably formed on the outer peripheral surface of the porous membrane portion 12. The size of the storage portion 20 is not limited, but the radial height of the storage portion (hereinafter also referred to as "the thickness of the storage portion") is in the range of 10 to 50% of the internal diameter d of the cylinder 10.

(3) Inlet 22

The inlet 22 for introducing the source liquids is preferably formed by creating a hole in the outer peripheral member 40 as shown in FIG. 1. The cross-sectional shape of the inlet 22 to be formed is not limited but is preferably circular. The cross-sectional area is determined so that a desired membrane permeation rate can be achieved. The inlet 22 can be formed at one or more places—holes may be bored on the outer peripheral part of the cylinder in a radial fashion. The total cross-sectional area of the inlet is preferably in the range of 0.2 to 20% of the effective membrane area. The inlet 22 can be formed at any position along the longitudinal direction of the cylinder 10, but is preferably formed at the central part.

(4) Outlet 30

The cylinder 10 is preferably provided with an outlet 30 at its both ends. As described above, the device of the present invention is required to deliver high discharge capacity. Although a supplying means is omitted in FIG. 1, the capability of the supplying means to achieve the aforementioned membrane permeation rate F, i.e., membrane permeation rate capability V, as well as L/d are preferred to satisfy the following relationships:

when 50 $m^3/m^2h \le V \le 200$ $m^3/m^2h$, then $2 \le L/d \le 45$;

when 200 $m^3/m^2h < V \le 400$ $m^3/m^2h$, then $2 \le L/d \le 23$;

when 400 $m^3/m^2h < V \le 800$ $m^3/m^2h$, then $1 \le L/d \le 12$;

when 800 $m^3/m^2h < V \le 1600$ $m^3/m^2h$, then $1 \le L/d \le 6$;

when 1600 $m^3/m^2h < V \le 2000$ $m^3/m^2h$, then $1 \le L/d \le 4.4$.

EXAMPLES

Example 1

<Provision of a Production Device>

There was provided a cylinder 10 composed of a hydrophilic SPG membrane (10 mm in external diameter) produced by SPG Technology Co., Ltd. And as shown in FIG. 1, an outer peripheral member 40 with an external diameter of 50 mm and made of stainless steel was disposed around this membrane, with seals 50 (O-rings) being provided near the ends of the cylinder 10. In this example, the length of a portion that extends between the seals 50 arranged near the ends of the cylinder 10 and which functions as a porous membrane facing a storage portion 20 (i.e., effective membrane length L) was 10 mm.

An inlet 22 with an internal diameter of 5 mm which was intended for fluid introduction was formed at two places in the longitudinally intermediate part of the outer peripheral member 40. The inlets 22 were communicated with the storage portion 20 formed between the cylinder 10 and the outer peripheral member 40. The radial length of the storage portion 20 (i.e., thickness of the storage portion) was 2 mm.

The cylinder 10 was provided with an outlet 30 at its ends, and the outer peripheral member 40 was provided with discharge inlets 42 connected to the outlets 30.

Thus, a production device 1 was provided.

<Production of a Composition>

Figure 2:
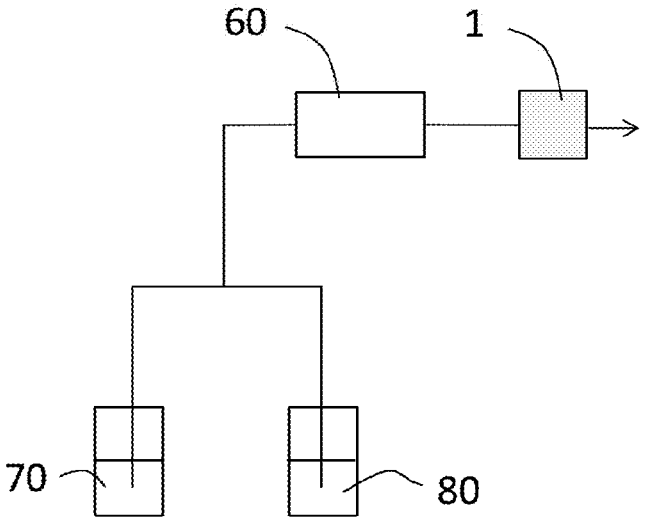
FIG. 2 is a diagram illustrating one mode of the production method of this invention.

There were provided, as a continuous phase liquid, a solution of 1.0% by mass of the nonionic surfactant Tween 20 (produced by Nacalai Tesque, Inc.) in water, and as a disperse phase liquid, liquid paraffin (produced by Nacalai Tesque, Inc.). As shown in FIG. 2, one pump (produced by Nihon Seimitsu Kagaku Co., Ltd.; NP-GXL 400) was used as a supplying means 60; and, after the two liquids provided above were drawn from a continuous phase liquid tank 70 and a disperse phase liquid tank 80, respectively, at a flow rate of 200 mL/min and were merged together, the liquids were suctioned into the plunger pump via a check valve installed on the suction side of the pump until a specified volume was occupied. Then, the liquids were delivered into a pipe via a check valve installed on the delivery side of the pump, and immediately supplied from the inlets 22 of the production device 1 to a porous membrane portion 12 of the cylinder 10. Compositions were produced first using a porous membrane with an average pore size of 5 μm, then the one with an average pore size of 10 μm, and finally the one with an average pore size of 20 μm. The membrane permeation rate adopted in all cases was 80 $m^3/m^2h$.

The results are shown in Table 1. The composition obtained using the SPG membrane with a pore size of 5 μm was an oil droplet-in-water emulsion with an average droplet size of 4.2 μm and a monodispersity index (span) of 0.48. The composition obtained using the SPG membrane with a pore size of 10 μm was an oil droplet-in-water emulsion with an average droplet size of 9.0 μm and a span of 0.47. The composition obtained using the SPG membrane with a pore size of 20 μm was an oil droplet-in-water emulsion with an average droplet size of 19.8 μm and a span of 0.52. The droplet size distributions in the emulsions were measured using a particle size distribution analyzer (SALD-200V) produced by Shimadzu Corporation.

All the emulsions had a disperse phase content of 50% by volume.

The pump used in this example was a pulsation-free double plunger pump. The plunger pump imparted little shear force to liquid feed during the suction and delivery steps, and there was no sign of micronization, etc. of oil droplets in the delivery liquid. The liquid mixture discharged from the pump had an average droplet size of 43 μm and a span of 0.52. It was found that such coarse emulsification occurred when the liquid mixture passed through the check valves installed on the suction and delivery ports of the plunger pump. Therefore, it was shown that this pump is superior as a pre-emulsification device.

Example 2

Figure 3:
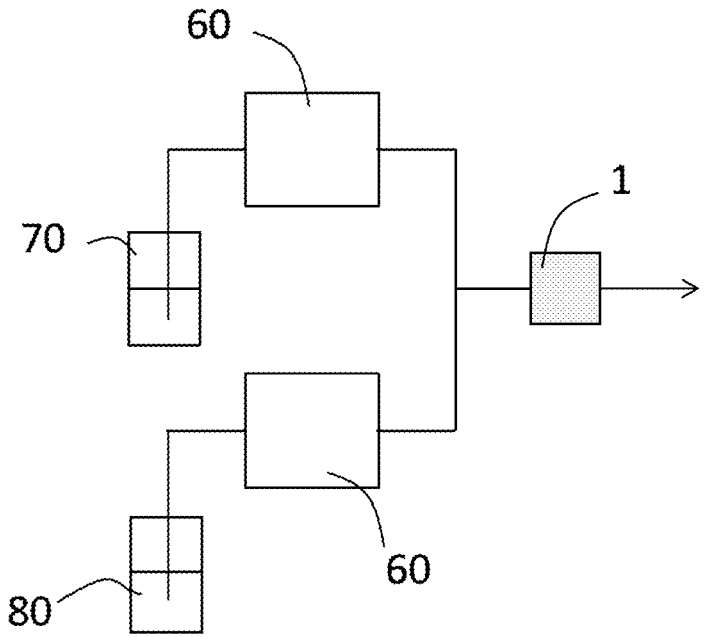
FIG. 3 is a diagram illustrating one mode of the production method of this invention.

There were provided the same continuous phase liquid and disperse phase liquid as in Example 1. As shown in FIG. 3, two pumps (produced by Nihon Seimitsu Kagaku Co., Ltd.; NP-GXL 400) were used as a supplying means 60; so, the two liquids provided above were separately suctioned from a continuous phase liquid tank 70 and a disperse phase liquid tank 80. The feed rate of the continuous phase liquid (aqueous solution) was set to 300 mL/min, and that of the disperse phase liquid (liquid paraffin) was to 100 mL/min. The liquids were merged together using a T-shaped coupling with an internal diameter of 5 mm, and the mixed stream was supplied to a porous membrane portion 12 of a production device 1 in the same manner as in Example 1. Also like in Example 1, compositions were produced using porous membranes with average pore sizes of 5, 10 and 20 μm. The membrane permeation rate adopted in all cases was 80 $m^3/m^2h$.

The results are shown in Table 1. The composition obtained using the SPG membrane with a pore size of 5 μm was an oil droplet-in-water emulsion with an average droplet size of 4.2 μm and a span of 0.51. The composition obtained using the SPG membrane with a pore size of 10 μm was an oil droplet-in-water emulsion with an average droplet size of 10.8 μm and a span of 0.53. The composition obtained using the SPG membrane with a pore size of 20 μm was an oil droplet-in-water emulsion with an average droplet size of 20 μm and a span of 0.50. All the emulsions had a disperse phase content of 25% by volume.

It was visually confirmed that the disperse phase droplets supplied to the porous membrane in this example had a diameter of about 5 mm. Since comparable emulsions to those in Example 1 were prepared in Example 2 as described above, it was demonstrated that pre-emulsification is not essential for intra-membrane emulsification.

Example 3

Figure 4:
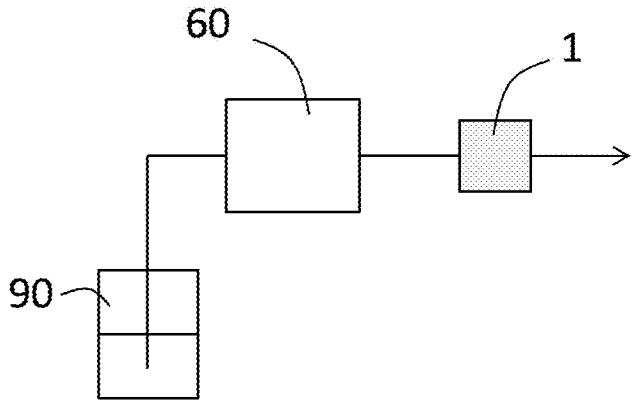
FIG. 4 is a diagram illustrating one mode of the production method of this invention.

There were provided, as a continuous phase liquid, 200 mL of a solution of 0.5% by mass Tween 20 in water, and as a disperse phase liquid, 200 mL of low-viscosity liquid paraffin (produced by Nacalai Tesque, Inc.). These liquids were pre-emulsified by stirring at 5000 rpm for 30 seconds using the homogenizer AHG-1600 produced by AS ONE Corporation. The resultant pre-emulsion had an average droplet size of 43 μm. As shown in FIG. 4, the pre-emulsion was charged into a pre-emulsion tank 90 and supplied to a porous membrane at a rate of 400 mL/min using a pressure liquid feed pump (produced by Nihon Seimitsu Kagaku Co., Ltd.; NP-GXL 400) as a supplying means 60. The porous membrane used was the same as that used in Example 1. The membrane permeation rate adopted in all cases was 80 $m^3/m^2h$.

The results are shown in Table 1. The composition obtained using the SPG membrane with a pore size of 5 μm was an oil droplet-in-water emulsion with an average droplet size of 4.2 μm and a span of 0.43. The composition obtained using the SPG membrane with a pore size of 10 μm was an oil droplet-in-water emulsion with an average droplet size of 9.0 μm and a span of 0.45. The composition obtained using the SPG membrane with a pore size of 20 μm was an oil droplet-in-water emulsion with an average droplet size of 19.6 μm and a span of 0.48. All the emulsions had a disperse phase content of 50% by volume.

TABLE 1

| | Average pore size of membrane [μm] | Average droplet size [μm] | Span |
|---|---|---|---|
| Example 1 | 5 | 4.2 | 0.48 |
| | 10 | 9.0 | 0.47 |
| | 20 | 19.8 | 0.52 |
| Example 2 | 5 | 4.2 | 0.51 |
| | 10 | 10.8 | 0.53 |
| | 20 | 20 | 0.50 |
| Example 3 | 5 | 4.2 | 0.43 |
| | 10 | 9.0 | 0.45 |
| | 20 | 19.6 | 0.48 |

Since no significant difference was observed among the results obtained in Examples 1-3 as described above, it was confirmed that no pre-emulsification is required for emulsion in a porous membrane.

Example 4

In order to determine the highest membrane permeation rate possible that allows production of a monodispersed emulsion, there were provided, as a continuous phase liquid, a solution of 1.0% by mass Tween 20 in water, and as a disperse phase liquid, low-viscosity liquid paraffin. As in Example 1, compositions were produced by the method illustrated in FIG. 2. However, the porous membrane used was a hydrophilic SPG membrane with an average pore size of 10 μm, and a porous membrane portion 12 was entirely coated with a partially perforated non-permeable film to adjust the effective area of the membrane. More specifically, the membrane was coated with a non-permeable film (PTFE seal tape produced by ICHIAS Corporation) having an opening 4 mm in diameter to limit the effective area of the membrane to 0.125 $cm^2$. The output of a pressure liquid feed pump 60 was adjusted to set the membrane permeation rate to 20 to 1910 $m^3/m^2h$. The emulsions prepared in this example had a disperse phase content of 50% by volume. The results are shown in Table 2.

TABLE 2

Relationship between membrane permeation rate and droplet size

| Membrane permeation rate [$m^3/m^2h$] | Average pore size of membrane 5 μm | 10 μm | 20 μm |
|---|---|---|---|
| 40 | 6 | 11 | 17.1 |
| 50 | 5.6 | 10.4 | 16.2 |
| 120 | 4.8 | 9.2 | 15 |
| 210 | 4.2 | 8.5 | 14.3 |

TABLE 2-continued

Relationship between membrane permeation rate and droplet size

| Membrane permeation rate [$m^3/m^2h$] | Average pore size of membrane 5 μm | 10 μm | 20 μm |
|---|---|---|---|
| 300 | 3.8 | 7.6 | 13.6 |
| 480 | 3.4 | 7.1 | 12.7 |
| 950 | 3.2 | 6.6 | 11.9 |
| 1430 | 2.5 | 5.6 | 9.9 |
| 1910 | 2.3 | 4.7 | 9.1 |

The measured values shown in this table are droplet sizes (μm).

Surfactant: 1% by mass Tween 20

Further compositions were produced using, as a continuous phase liquid, a solution of 1.0% by mass of the ionic surfactant sodium lauryl(dodecyl)sulfate (produced by Nacalai Tesque, Inc.) in water, instead of the aqueous 1.0% by mass Tween 20 solution. The results are shown in Table 3.

TABLE 3

Relationship between membrane permeation rate and droplet size

| Membrane permeation rate [$m^3/m^2h$] | Average pore size of membrane 5 μm | 20 μm |
|---|---|---|
| 40 | 5.4 | 14.2 |
| 50 | 4.9 | 13.7 |
| 120 | 4.1 | 12.1 |
| 210 | 3.5 | 11.3 |
| 300 | 3.1 | 9.9 |
| 480 | 2.5 | 8.9 |
| 950 | 1.9 | 7.4 |
| 1430 | 1.7 | 6.6 |
| 1910 | 1.3 | 5.8 |

The measured values shown in this table are droplet sizes (μm).

Surfactant: 1% by mass SDS

Figure 6:
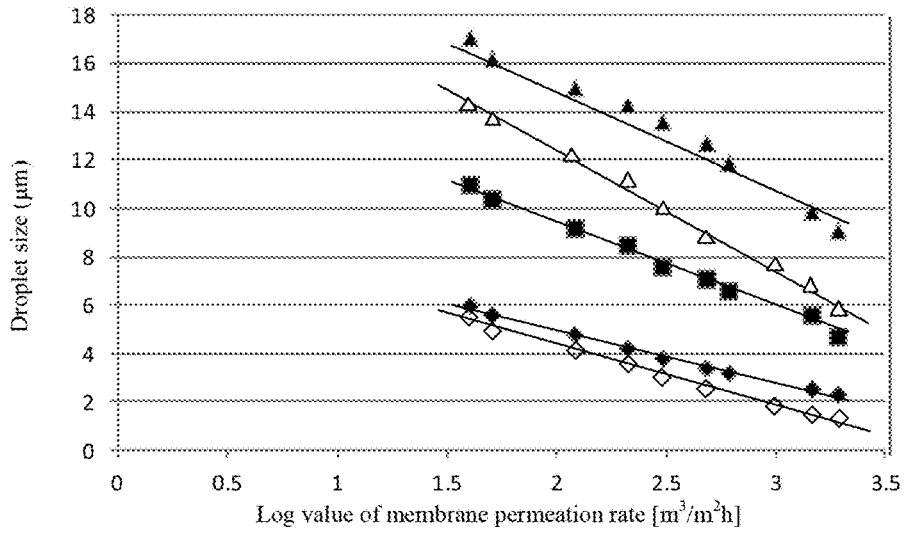
FIG. 6 is a diagram illustrating the relationship between membrane permeation rate and droplet size.

FIG. 6 is a graph of the average droplet sizes produced plotted against the log values of membrane permeation rate. This figure showed that the average droplet size produced by emulsification in a porous membrane decreases linearly with the log value of membrane permeation rate. More specifically, in the case of using the aqueous 1.0% by mass Tween 20 solution as a continuous phase liquid, and the membrane 10 μm in average pore size as a porous membrane, the emulsions produced at the membrane permeation rates of 20, 50 and 1430 $m^3/m^2h$ had average droplet sizes of 15 μm (ratio to pore size, 1.5), 10.4 μm (ratio to pore size, 1.04) and 5.6 μm (ratio to pore size, 0.56), respectively. There was a tendency in which emulsions having a pore size ratio of not greater than 0.5 show polydispersity. It was also found that emulsions produced using an ionic surfactant experience a decrease in average droplet size.

Patent Literature 3 (JP 2006-346565 A) discloses the results of intra-membrane emulsification by a repeated membrane permeation method with a SPG membrane 5.3 μm in average pore size, using an aqueous solution of 0.5% by mass sodium dodecyl sulfate as a continuous phase liquid, and paraffin oil as a disperse phase liquid (Patent Literature 3, Examples). The results report that emulsions obtained after 1, 20 and 50 times of membrane permeation had droplet diameters of 4.360 μm, 3.705 μm and 3.036 μm, respectively—the average droplet size decreases with the number of times of membrane permeation. In contrast to this, it is shown that the present invention enables micronization of droplets into a finer size than in the case of Patent Literature 3 after a single membrane permeation by increasing a membrane permeation rate.

Example 5

The influence of the viscosity of a continuous phase liquid was investigated. As a continuous phase liquid was used a mixture obtained by adding carboxymethyl cellulose (CMC) (produced by Nacalai Tesque, Inc.) to an aqueous 0.5% Tween 20 solution to adjust the viscosity to 1, 55 or 85 mPa·s. As a disperse phase liquid, low-viscosity liquid paraffin (17 mPa·s) was used. The viscosity was measured at 21° C. using the viscometer VISCOMATE model VM-10A produced by Sekonic Corporation. The continuous phase liquid and the disperse phase liquid were supplied to a production device 1 by the method illustrated in FIG. 3. The disperse phase content employed in this example was 25% by volume. The porous membrane used was a hydrophilic SPG membrane with an average pore size of 20 μm (10 mm in external diameter×10 mm in effective membrane length). The membrane permeation rate was 80 $m^3/m^2h$. In this example, membrane permeation was repeated one to four times to determine the influence of the viscosity of the continuous phase on average droplet size.

Figure 7:
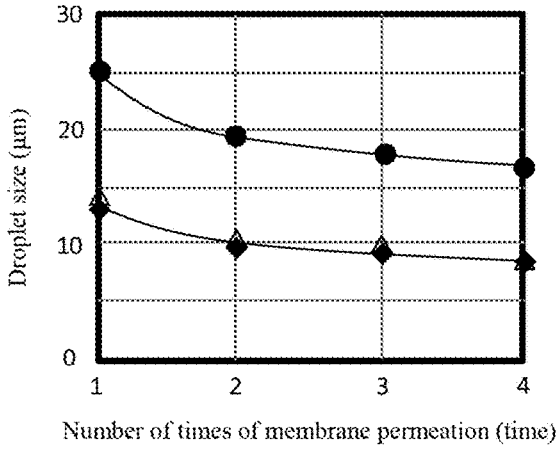
FIG. 7 is a diagram illustrating the relationship of the viscosities of a continuous phase liquid and a disperse phase liquid with droplet size.

The results are shown in FIG. 7. In the case of using the continuous phase liquid with a viscosity of 1 mPa·s (no CMC added), an emulsion obtained after a single membrane permeation had an average droplet size of 24.6 μm, but an emulsion obtained after 4 times of membrane permeation showed a decrease in average droplet size to 17.4 μm. In the case of using the continuous phase liquid with a viscosity of 55 mPa·s, an emulsion obtained after a single membrane permeation had an average droplet size of 12.4 μm, but an emulsion obtained after 4 times of membrane permeation showed a decrease in average droplet size to 8.0 μm, which is less than half of the average pore size (20 μm) of the porous membrane. Increasing the viscosity of a continuous phase to a much higher value had little influence on the droplet size produced. All the emulsions obtained in this example showed monodispersity.

As seen from the above, it was found that increasing the viscosity of a liquid serving as a continuous phase is effective to reduce the ratio of droplets produced to pore size.

Example 6

The influence of the viscosities of a continuous phase liquid and a disperse phase liquid was investigated. As in Example 5, mixtures obtained by adding carboxymethyl cellulose (CMC) to an aqueous 0.5% by mass Tween 20 solution to adjust the viscosity (to 1, 55 or 85 mPa·s) were used as a continuous phase liquid. As a disperse phase liquid, high-viscosity liquid paraffin (250 mPa·s) (produced by Nacalai Tesque, Inc.) was used. The continuous phase liquid and the disperse phase liquid were supplied to a production device 1 by the method illustrated in FIG. 3. The emulsions prepared in this example had a disperse phase content of 25% by mass. The porous membrane used was the same as used in Example 5. The membrane permeation rate was set to 80 $m^3/m^2h$. In this example, membrane permeation was repeated one to four times to determine the influence of the viscosity of the disperse phase on average droplet size.

Figure 8:
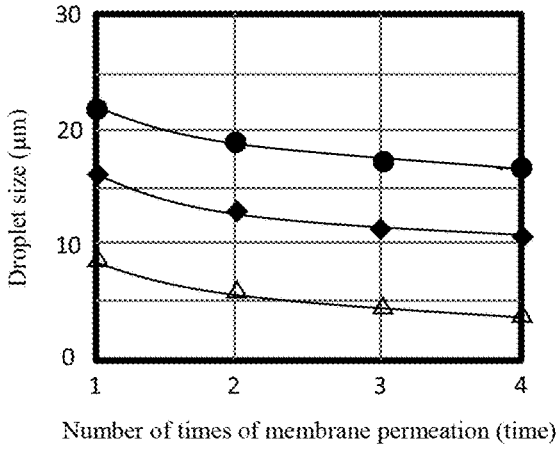
FIG. 8 is a diagram illustrating the relationship of the viscosities of a continuous phase liquid and a disperse phase liquid with droplet size.

The results are shown in FIG. 8. In the case of using the disperse phase liquid with a viscosity of 250 mPa·s and the continuous phase liquid with a viscosity of 1 mPa·s, the average droplet size decreased from 22 μm to 17.5 μm with the number of times of membrane permeation. In the case of using the continuous phase liquid with a viscosity of 55 mPa·s, the average droplet size produced significantly decreased from 17 μm to 11 μm. All the emulsions produced using the continuous phase liquids with viscosities of 1 and 55 mPa·s were monodispersed ones. In the case of using the continuous phase liquid with a viscosity of 85 mPa·s, a significant decrease in droplet size was observed, but it was found that the emulsions prepared under this condition had a span of not smaller than 1 and showed polydispersity.

Comparison between the results given in FIGS. 7 and 8 showed that the droplet size produced is significantly influenced by the viscosity of a continuous phase but little influenced by the viscosity of a disperse phase.

[Example 7] Production of a Composite Emulsion

Figure 5:
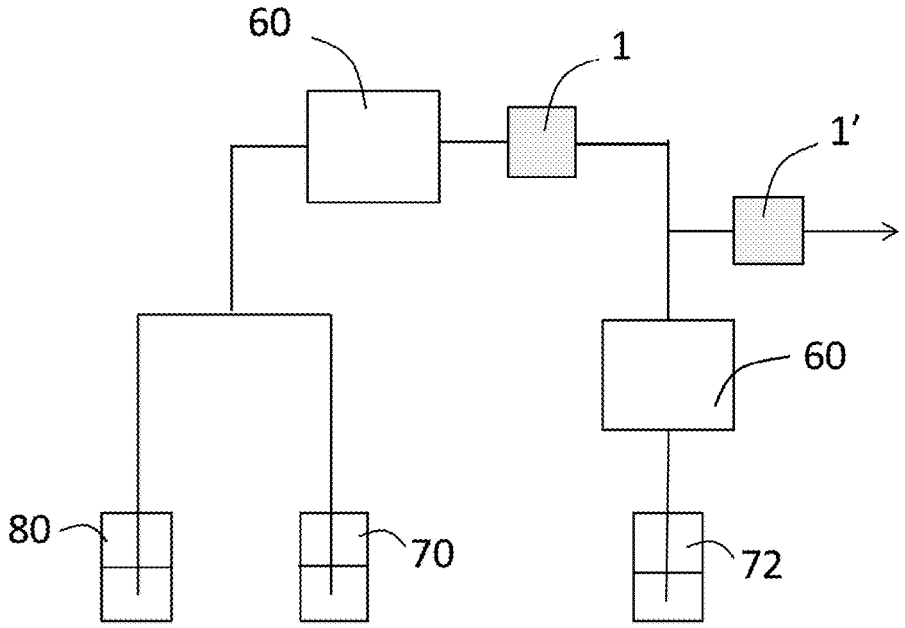
FIG. 5 is a diagram illustrating one mode of the production method of this invention.

A W/O/W composite emulsion was produced. First of all, as shown in FIG. 5, deionized water was provided as a first disperse phase liquid serving as an internal aqueous phase, and a mixture obtained by adding 2% by mass of the nonionic surfactant Span 80 (produced by Nacalai Tesque, Inc.) to low-viscosity liquid paraffin was provided as a first continuous phase liquid serving as an oil phase. These liquids were supplied to a production device 1 (using, as a porous membrane, a hydrophobic SPG membrane 5 μm in average pore size, 10 mm in external diameter, and 10 mm in effective membrane length) at a membrane permeation rate of 90 $m^3/m^2h$ to obtain a primary water droplet-in-oil emulsion. This emulsion had a volume ratio of internal aqueous phase to oil phase of 1:1, an average droplet size of 4.4 and a span of 0.47.

Next, an aqueous 1% by mass Tween 20 solution was provided as a second continuous phase liquid serving as an external aqueous phase. This liquid was fed by a supplying means 60 (a pump produced by Nihon Seimitsu Kagaku Co., Ltd.; NP-GXL 400), merged in a pipe with the water droplet-in-oil emulsion prepared above, and supplied to a production device 1' (using, as a porous membrane, a hydrophilic SPG membrane 20 μm in average pore size, 10 mm in external diameter, and 10 mm in effective membrane length) at a membrane permeation rate of 180 $m^3/m^2h$ to obtain a W/O/W composite emulsion.

The resultant emulsion had an average droplet size of 10.4 μm and a span of 0.5. As described above, introduction of emulsification in a porous membrane which requires no pre-emulsification enabled production of a monodispersed W/O/W emulsion having a disperse phase content of 50% by volume in a sequence of consecutive steps. The present invention does not require pre-emulsification of a primary emulsion and an external aqueous phase liquid, and thus makes it possible to produce a composite emulsion which is very high in active ingredient encapsulation rate, without causing the destruction of internal aqueous phase droplets.

Speaking of this composite emulsion, multiple internal aqueous phase droplets were observed in each of oil droplets for several days after the production, but these internal aqueous phase droplets coalesced into a single water droplet after a lapse of about 10 days. In other words, it was shown that a composite emulsion having a single droplet encapsulated therein was formed successfully.

REFERENCE SIGNS LIST

1 Production device
1' Production device
10 Cylinder
12 Porous membrane portion
20 Storage portion
22 Inlet
30 Outlet
40 Outer peripheral member
42 Discharge inlet
50 Seal
60 Supplying means
70 Continuous phase liquid tank
72 Continuous phase liquid tank
80 Disperse phase liquid tank
90 Pre-emulsion tank
L Effective membrane length

The invention claimed is:

1. A method for producing a composition having greater than 20% by volume of a disperse phase dispersed in a continuous phase, the method comprising:

providing a mixture comprising a continuous phase liquid and a disperse phase liquid; and conducting a permeation step at which the continuous phase liquid and the disperse phase liquid are caused to simultaneously permeate a porous membrane having an average pore size of not smaller than 5 μm at a membrane permeation rate of not lower than 50 $m^3/m^2h$, wherein the permeation step is carried out by using a production device comprising:

a cylinder having a circumferential surface partially or wholly composed of a porous membrane, the cylinder being provided, in the cross sections of both ends thereof, with outlets for the composition having the disperse phase finely dispersed in the continuous phase;

a storage portion for storing the continuous phase liquid and the disperse phase fluid, the storage portion being provided on an outer periphery of the circumferential surface of the cylinder; and a pump and/or a pipe for simultaneously supplying the continuous phase liquid and the disperse phase fluid from the storage portion into the cylinder, and wherein, when the longitudinal length of a porous membrane portion is defined as an effective membrane length L and the internal diameter of the outlets is defined as d, L/d and the membrane permeation rate F satisfy the following relationships:

when 50 $m^3/m^2h \le F \le 200$ $m^3/m^2h$, then $2 \le L/d \le 45$;

when 200 $m^3/m^2h < F \le 400$ $m^3/m^2h$, then $2 \le L/d \le 23$;

when 400 $m^3/m^2h < F \le 800$ $m^3/m^2h$, then $1 \le L/d \le 12$;

when 800 $m^3/m^2h < F \le 1600$ $m^3/m^2h$, then $1 \le L/d \le 6$;

when 1600 $m^3/m^2h < F \le 2000$ $m^3/m^2h$, then $1 \le L/d \le 4.4$.

2. The method according to claim 1, wherein the disperse phase in the composition has an average particle size that is smaller than the average pore size of the porous membrane.

3. The method according to claim 1 or 2, wherein the disperse phase in the composition has a span, as defined by the following equation (1), of 0.4 to 0.6:

$$\text{Span}=(d_{90}-d_{10})/d_{50} \quad (1)$$

where:

$d_{10}$: a particle size when the cumulative distribution of disperse phase particles is 10%, $d_{90}$: a particle size when the cumulative distribution of disperse phase particles is 90%, and $d_{50}$: a particle size when the cumulative distribution of disperse phase particles is 50%.

4. The method according to claim 1, wherein the permeation step is carried out only once.

5. The method according to claim 1, wherein the membrane permeation rate is in the range of 60-2000 $m^3/m^2h$.

6. The method according to claim 1, wherein the continuous phase contains, as a surfactant, 0.1-5% by mass of an anionic surfactant.

* * * * *